United States Patent [19]

Knott

[11] 4,423,962

[45] Jan. 3, 1984

[54] DEVICE FOR THE DISAGGREGATION OF POWDERY MATERIAL IN A RESERVOIR

[75] Inventor: Joseph Knott, Tutzing, Fed. Rep. of Germany

[73] Assignee: Siemens Aktiengesellschaft, Berlin & Munich, Fed. Rep. of Germany

[21] Appl. No.: 365,789

[22] Filed: Apr. 5, 1982

[30] Foreign Application Priority Data

Apr. 15, 1981 [DE] Fed. Rep. of Germany ..... 3115304

[51] Int. Cl.[3] ..... B01F 7/02

[52] U.S. Cl. ..... 366/279

[58] Field of Search ..... 366/279, 331, 245, 246, 366/286, 308; 403/193, 281, 368, 369, 329, 284; 52/223 L; 267/158, 160; 16/2; 118/612

[56] References Cited

U.S. PATENT DOCUMENTS

| | | | |
|---|---|---|---|
| 2,025,556 | 12/1935 | Stahl | 403/369 |
| 2,437,111 | 3/1948 | McKeige | 403/193 X |
| 3,638,975 | 2/1972 | Buettner | 403/284 |
| 3,820,832 | 6/1974 | Brandestini et al. | 403/368 X |
| 3,876,317 | 4/1975 | Jordan | 403/329 X |
| 3,879,147 | 4/1975 | Morell | 403/369 |
| 3,954,331 | 5/1976 | Smith . | |

FOREIGN PATENT DOCUMENTS

| | | | |
|---|---|---|---|
| 117002 | 6/1943 | Australia | 403/284 |
| 7047 | 1/1980 | European Pat. Off. . | |
| 456906 | 7/1968 | Switzerland | 52/223 L |

*Primary Examiner*—Philip R. Coe
*Assistant Examiner*—Thomas W. Epting
*Attorney, Agent, or Firm*—Hill, Van Santen, Steadman & Simpson

[57] ABSTRACT

For the raking and otherwise disaggregation of powdery material in a reservoir chamber, there is provided an agitator unit comprising a laterally extending shaft disposed for rotation in the reservoir on which is mounted a pair of laterally spaced disks with strip lengths or cables stretched between the disks. The cables serve to provide a raking surface which prevents the powdery material from clumping and the agitator unit is rotated in the reservoir. The opposed ends of the cables are connected to the disks by means of clamping devices which are interchangeably disposed in corresponding bores formed along the outer edges of the disks. Each clamping device comprises a bush part having a lateral passage for receiving therethrough a corresponding free end of the cable. The bush is rigidly connected to the free end of the cable by means of a compressed or pinched fit and the bush is secured in the disk bore as the result of suitable stop surface means. A leaf spring plate is secured to the disk to resiliently hold the bush in place in the disk bore. As the result of the clamping device, the likelihood of a tension rupture of the cable is reduced and projecting free ends of the cables are able to be disposed within the area between the disk and the adjacent sidewall of the reservoir.

10 Claims, 2 Drawing Figures

DEVICE FOR THE DISAGGREGATION OF POWDERY MATERIAL IN A RESERVOIR

BACKGROUND OF THE INVENTION

The invention relates to apparatus for the disaggregation of powder or particulate material contained in a reservoir and, more particularly, to the construction of an agitator device disposed for rotation within the reservoir. The invention is particularly useful for the treatment of toner powder contained in a reservoir dispenser connected with the developer station of an electrophotographic or electrographic printer or copier.

Instances frequently arise where powder-like solids material must be extracted from a reservoir supply and conducted to a user station, particularly as relates to the handling of toner powder for use in magnetic brush-type developer stations in non-mechanical copying or printing machines. Such printing or copying machines typically function according to electrophotographic or electrographic principles, wherein electrostatic latent images of characters to be printed are generated on a recording medium, such as a photoconductive drum or a specially treated paper. The drum or paper has on it a semi-conductor layer of photo-electrical or di-electrical material on which electrostatic charge images of the characters to be printed or copied are generated. These electrostatic images are subsequently inked with a toner powder in a developer station. The developer station typically includes at least one developer unit generally referred to in the art as a magnetic brush developer. The magnetic brush developer, as a rule, contains a magnetic brush or drum mounted for rotation so as to continually bring developer mix, comprising carrier and toner particles, into contact with the electrostatic images recorded on the semi-conductor layer, whereupon the charge images are inked by adherence of toner particles to the charge images. As a result of the consumption of toner powder in the developer station, it is necessary to add additional toner from time-to-time and, in this regard, most developer stations include a toner dispenser containing a fresh supply of toner.

Since toner powder is a pulverized synthetic, it is difficult to pour and cannot be dumped and easily aggregates in clumps. There are known toner dispenser constructions for the conveying of toner powder from a reservoir to a developer station. For example, U.S. Pat. No. 3,954,331 discloses an upright toner reservoir mounted over a developer station housing having an open lower end to receive a gravitational flow of toner. Beneath the open end of the reservoir is a dispensing roll mounted for rotation in a hopper whereby toner powder is metered through the hopper for passage into the developer station. The European Patent application No. 0,007,047 discloses a toner powder reservoir for use in connection with a printer or copier developer station wherein the reservoir is a housing containing a rotary shaft extending between opposed sidewalls. Disposed on the shaft are two coaxial spaced-apart disks between which one or more wires are stretched. As the shaft rotates, the toner powder in the reservoir is raked so that clump formation is avoided and the toner powder can reliably fall under gravity from the reservoir into a solids conveyor for conduction into the developer station. In order to avoid friction build-up, the device of the European Patent application necessitates that the stripping or raking wires be made as thin as possible. Accordingly, the wires are subject to easy breakage at their connection points with the disks due to linear flexing of the wires during raking movement. This leads to the possibility of small, broken-off wire pieces falling into the toner powder supply and being conveyed to the developer station disrupting the inking process and causing damage to the working elements of the station. A further disadvantage in this device is that the disks are disposed very close to the opposed sidewalls of the reservoir, such that toner powder tends to become aggregated in clumps between the disks and the sidewalls which produces a resistance friction force on the rotation of the shaft and makes complete mixing of the toner powder more difficult.

An object of the present invention is to effect an agitator arrangement for powdery material contained in a reservoir in which the possibility of breakage of raking wires is significantly reduced in that the connection ends of the wires to the disks are reliably held against the disks by means of selectively interchangeable clamping members.

SUMMARY OF THE INVENTION

A reservoir chamber containing a supply of powdery material, such as toner for use in the developing station of a non-mechanical copying or printing machine, is provided with a transversely extending rotatable agitator unit which serves to prevent the powdery material from aggregating in clumps and adhering to the chamber walls. Accordingly, the powdery material is kept in a condition conducive for dispensing from the reservoir in metered volumes. The agitator unit comprises a rotary shaft having connected thereto a pair of spaced-apart, coaxial disk or plate members. One or more strip members, such as in the form of wire or cable, are connected between facing sides of the disks for raking through the powdery material supply during rotation of the shaft.

The strip lengths are connected at each end to the corresponding disk by means of a respective clamping arrangement. The clamping arrangement includes a cylindrical bush having a lateral passageway therethrough and divided into inner and outer facing portions by a relatively enlarged flange portion. The bush passageway receives one end of the strip length therethrough such that a free end is exposed for extension into the area between the disk and adjacent sidewall of the reservoir. The bush is rigidly affixed to the strip length free end by collapsing the outer portion in a compressed fit about the strip. Each disk is formed with a laterally directed stepped bore having a narrow opening portion along the inner facing side of the disk and a relatively enlarged portion along the outer side of the disk. The bush is received within the stepped bore such that the inner portion extends through the narrow bore portion and the flange is positioned within the larger bore portion abutting against a transition wall of the bore holding the bush against inward lateral movement. The bush is held in place within the stepped bore by a leaf spring plate mounted along the outer side of the disk for resiliently pressing the flange against the bore transition wall. The spring plate is formed with an opening which fits about the free end portion of the strip length and the outer bush portion into abutment with the outer wall of the flange.

The disks are located along the shaft significantly spaced from the adjacent sidewalls of the chamber so that powdery material cannot aggregate in clumps in this area. The free ends of the stripping length project beyond the clamping devices into these spaces for raking or agitating of the powdery material located there.

DESCRIPTION OF THE PREFERRED EMBODIMENT

Figure 1:
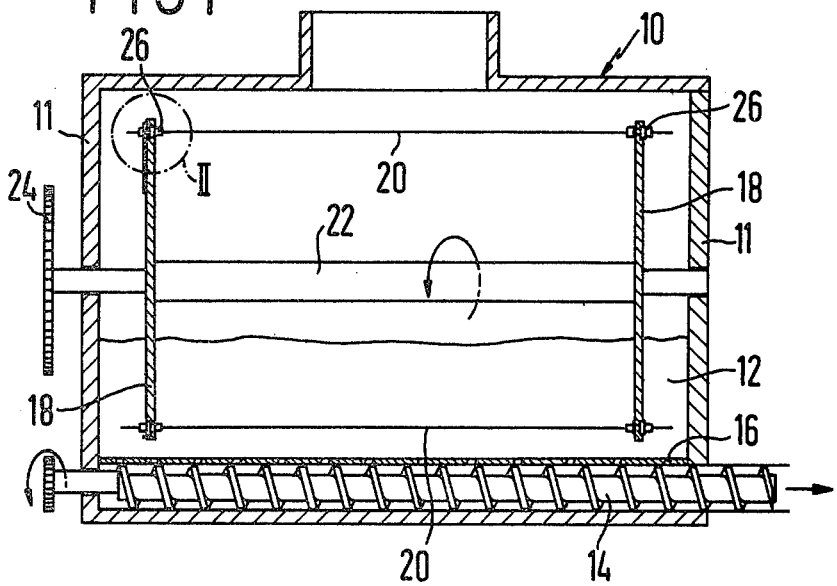
FIG. 1 is a cross-sectional, side elevational view of a reservoir containing powdery material having an agitator unit constructed in accordance with the present invention.

FIG. 1 illustrates a reservoir chamber 10 for containing a supply of powdery material 12, such as toner powder for use in the developer station of a non-mechanical printing or copying machine. The powdery material is disposed along the floor of the reservoir 10 in a loose pile. The floor is provided with a plurality of suitable slots or openings 16 through which the powdery material falls under gravity into the transport spaces of a suitable solids conveyor 14, such as a screw conveyor. The conveyor 14 is adapted for rotation such that the powdery material contained thereby is transported laterally leftward in the direction of the arrow shown in FIG. 1 to a suitable user station, such as the developer station in the case of toner powder.

Since powdery material, such as in the case of toner particles, has poor flow characteristics, i.e., it tends to aggregate or clump and adheres to housing walls, an agitator device is disposed within the reservoir 10 for continuous raking or otherwise disaggregate the powdery material. The agitator unit comprises a pair of laterally spaced disks or plates 18 coaxially mounted for rotation on a laterally extending shaft 22. The shaft 22 is suitably mounted for rotation between opposed sidewalls 11 of the reservoir 10 and driven via a drive transmission element 24 disposed exterior to the reservoir. A plurality of relatively thin strip lengths 20, preferably in the form of wires or cables, are stretched between the spaced-apart disks 18 to serve as raking or agitating surfaces passing through the pile of powdery material 12 during rotation of the shaft 22.

The strips 20 serve as modular pieces which are interchangeably secured at each opposed end to a corresponding disk by means of clamping arrangements 26. The clamping arrangements 26 serve to fasten the strips 20 to the disks 18 in a fashion which increases the useful life of the strips during agitating operation and reduces the chances of breakage of the strips at their connection points. The strips 20 may be in the form of steel cable of very small diameter, such as 1 mm made of a suitable raking material, such as a chrome-nickel composition. Although other constructions may be used for the strips 20, steel cable appears preferable due to its longer wear life as compared to, for example, steel wire.

Figure 2:
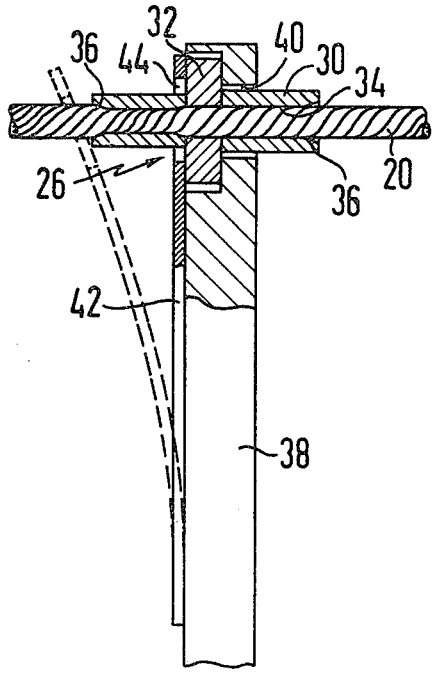
FIG. 2 is an enlarged fragmentary cross-sectional view of a clamping device constructed in accordance with the present invention shown at the area II of FIG. 1.

FIG. 2 illustrates in detail one of the clamping devices 26. There is an elongated bush member 30 in the form of a cylinder having a laterally extending passageway 34 for receiving therethrough the free end of a strip 20. The bush 30 is divided into inner and outer portions by an approximately centrally disposed flange portion 32 of relatively enlarged diameter. The free end of the strip 20 extends appreciably outward of the outer bush portion so as to be disposed between the outer wall of the corresponding disk 38 and the adjacent reservoir sidewall 11. The outer portion of the bush 30 is adapted to be collapsible so that the strip 20 may be secured in the bush as a result of pinching the outer bush portion into a compressed fit about the portion of the strip 20 contained within the outer bush portion. In order to reduce the collapsing stress on the strip length 20 in the bush 30, the passageway 34 is formed with opposed end flared openings 36.

The bush part 30 is in the form of a modular unit arranged for interchangeable placement in corresponding step bore openings 40 provided on the respective disks. The stepped bore 40 is formed about a laterally directed axis having a substantially narrow portion disposed along the inward facing side of the disk and a relatively enlarged opening portion disposed along the outer facing side of the disk. The bush 30 is inserted in the bore 40 such that the inner bush portion is received through the narrow opening of the bore and the relatively enlarged flange portion 32 is disposed in facing abutment with the transition wall surface formed in the enlarged bore opening portion.

In order to prevent the bush member 30 from sliding out of its bore 40 on the corresponding disk 38, a leaf spring plate 42 is mounted along the outer facing side surface of the disk. The spring plate 42 is provided with a suitable opening 44 for fitting over the free end of the strip 20 and the outer portion of the bush 30 into facing engagement with the outer facing sidewall of the flange part 32. The spring plate 42 is disposed in a manner such that it resiliently presses the flange part 32 into secured engagement with the transition wall surface of the stepped bore 40. The spring plate 42 is movable to a dotted line position as shown in FIG. 2 during positioning of the clamping unit bush 30 secured to the strip 20 on the disk. A significant advantage of the spring plate 42 is that the clamping bush 30 is prevented from sliding out of the disk bore 40 should the strip length 20 break during operation.

With reference to FIG. 1, the outer facing free ends of the strips 20 significantly project beyond the respective clamping arrangements 26 into the area between the disks 18 and the adjacent sidewalls 11 of the reservoir. It is thus possible to afford a significant spacing between the lateral walls 11 and the adjacent, corresponding disks 18 in such a manner that powdery material is unable to solidify into clumps or otherwise aggregate in this area. In this manner, smooth operation of the agitator unit and a more complete mixture of the powdery material 12 is possible. The powdery material disposed between the disks 18 and the adjacent sidewalls 11 is raked or otherwise agitated by means of the projecting free ends of the strip lengths 20 disposed in this area.

Although various minor modifications may be suggested by those versed in the art, it should be understood that I wish to embody within the scope of the patent warranted hereon all such modifications as reasonably and properly come within the scope of my contribution to the art.

1. Apparatus for the disaggregation of powdery toner material contained in a reservoir from which said toner material is fed to the developer station of a printing machine, comprising a lateral shaft seated for rotation in said reservoir with laterally spaced apart disks mounted on said shaft, at least one relatively thin strip stretched between said disks, a clamping means for fixedly engaging a corresponding free end of said strip, said clamping means being removably received in a lateral bore formed correspondingly on one said disk and held therein against lateral movement by stop means and said clamping means engaging said strip such that each corresponding free end thereof projects outward of said corresponding disk toward an adjacent sidewall of said reservoir for raking toner material between said disks and between said disks and adjacent sidewalls of said reservoir.

2. The apparatus of claim 1, wherein said clamping means comprises a bush having a lateral passageway for receiving therethrough said strip free end, said bush being divided into inner and outer opposed portions by a relatively enlarged flange portion, and said stop means comprises a wall surface in said bore against which the wall of said flange facing away from said strip free end abuts.

3. The apparatus of claim 2, wherein said bush is cylindrically shaped.

4. The apparatus of claim 3, wherein said strip is steel cable.

5. The apparatus of claim 2, wherein the free end of said strip projects through said bush outer portion toward the adjacent sidewall of said reservoir.

6. The apparatus of claim 5, wherein said bush is fixed to said strip free end by compressive collapse thereon of said bush outer portion.

7. The apparatus of claim 6, wherein said passageway in said bush outer portion has conically outward expanding opposed open ends.

8. The apparatus of claim 2, wherein said bore is stepped having an inner narrow portion for receiving therein said bush inner portion and an outer wide portion for receiving said bush flange portion, said bush inner portion facing away from the free end of said strip.

9. The apparatus of claim 8, wherein said stop means further comprises a spring plate positioned on said disk adjacent said bore outer portion, said spring plate resiliently pressing said flange against said wall surface in said bore.

10. The apparatus of claim 1, wherein said strip is a steel cable.

* * * * *